US005882449A

United States Patent [19]

Waldron et al.

[11] Patent Number: 5,882,449

[45] Date of Patent: Mar. 16, 1999

[54] PROCESS FOR PREPARING ALUMINUM/LITHIUM/SCANDIUM ROLLED SHEET PRODUCTS

[75] Inventors: Douglas J. Waldron, Fountain Valley; William F. Bozich, Huntington Beach, both of Calif.

[73] Assignee: McDonnell Douglas Corporation, Hazelwood, Mo.

[21] Appl. No.: 893,772

[22] Filed: Jul. 11, 1997

[51] Int. Cl.[6] ..... C21D 8/00

[52] U.S. Cl. ..... 148/693; 148/697

[58] Field of Search ..... 148/693, 697, 148/439

[56] References Cited

U.S. PATENT DOCUMENTS 4,844,750 7/1989 Cho et al. ..... 148/693

*Primary Examiner*—Deborah Yee

*Attorney, Agent, or Firm*—Brooks & Kushman P.C.

[57] ABSTRACT

Aluminum/lithium alloys displaying excellent weldability while also exhibiting isotropic physical properties is produced by including greater than 0.25 weight percent scandium and processing by a combination of low temperature hot working, recrystallization, optional cold working, and artificial aging. The alloy materials are particularly useful as aircraft and spacecraft components such as fuel tanks.

9 Claims, No Drawings

PROCESS FOR PREPARING ALUMINUM/LITHIUM/SCANDIUM ROLLED SHEET PRODUCTS

TECHNICAL FIELD

The present invention pertains to worked products, particularly rolled sheet products of aluminum/lithium alloys also containing scandium. The physical properties of the subject worked products are relatively isotropic, and in particular demonstrate excellent short transverse properties in sheet form.

BACKGROUND ART

Aluminum/lithium alloys have been proposed for many years, and several Al/Li alloys are produced commercially. Lithium, in appropriately formulated alloys, tends to increase alloy strength while providing for a lower density alloy at the same time. However, lithium is a very reactive metal, and smelting opera- tions are problematic. In some alloys and furnaces, the alloys are known to react with the refractory furnace lining, while other alloys are explosively oxidizable. Those factors increase the cost of the alloys considerable. A thorough discussion of aluminum/lithium alloys and some of the problems associated with their preparation and use may be found in Pickens et al, U.S. Pat. No. 5,211,910.

For these reasons, Al/Li alloys are generally reserved for applications where strength/weight ratios and other requirements outweigh cost disadvantages. However, even for many such applications, problems associated with such alloys such as weldability, work hardening, and the like render these alloys unsuitable. One example is the manufacture of fuel tanks for the aerospace industry. Several Russian alloys, i.e. 1421 and 1460, employ specific alloy compositions which encourage weldability. These alloys, like those discussed in U.S. Pat. No. 5,211,910, employ a modest amount of copper along with lithium. However, the Russian alloys also add a small amount of scandium. While these alloys exhibit vastly improved weldability, their physical properties, particularly short transverse properties, are severely deficient.

It would be desirable to provide sheet materials which offer high strength characteristics, uniform properties, i.e. which are substantially isotropic, and yet which are weldable.

DISCLOSURE OF THE INVENTION

The present invention pertains to unique aluminum/lithium worked products containing copper and scandium alloying elements, which are produced by a combination of hot and cold working followed by solution heat treating and aging. These materials surprisingly exhibit superior weldability while possessing excellent physical properties in all directions.

While one or more embodiments of this invention are disclosed, the embodiments should not be construed to limit the claims. It is anticipated that various modifications and alternative designs may be made without departing from the scope of this invention.

BEST MODE FOR CARRYING OUT THE INVENTION

The subject invention worked materials cannot be prepared by simply casting and working or rolling the relevant alloy compositions. Such processes produce worked or sheet materials which are far from isotropic. In particular, their short transverse properties suffer appreciably. Thus, the alloy must not only meet certain compositional limitations, but also must be processed in a particular manner as hereinafter described.

The alloy composition, including preferred ranges, is as follows:

| | Preferred | More Preferred | Most Preferred |
|---|---|---|---|
| Li | 1.5–3.0 | 1.8–2.3 | 2.05 |
| Cu | 1.0–4.0 | 2.5–3.0 | 2.7 |
| Sc | >0.25–10.0 | 0.23–1.0 | 0.3 |
| Si | 0.03–1.0 | 0.03–0.1 | 0.03 |
| Fe | 0.03–1.0 | 0.03–0.1 | 0.03 |
| Mn | 0.05–1.0 | 0.1–0.5 | 0.30 |
| Mg | 0.05–1.0 | 0.1–0.5 | 0.3 |
| Zn | 0.05–1.0 | 0.1–0.8 | 0.6 |
| Zr | 0.01–1.0 | 0.03–0.9 | 0.8 |
| Ti | 0.05–1.0 | 0.1–0.5 | 0.2 |
| Others | | | <0.50 |
| Al | balance | balance | balance |

The alloy itself is prepared by standard alloying techniques, preferably in an inert gas atmosphere. Thus, the alloy as described herein can be provided as an ingot or billet for fabrication into a suitable wrought product by casting techniques currently employed in the art for cast products, with continuous casting being preferred. Further, the alloy may be roll cast or slab cast to thicknesses from about 0.10 to 2 or 3 inches or more depending on the end product desired. The ingot or billet may be preliminarily worked or shaped to provide suitable stock from subsequent working operations.

Prior to the principal working operation, the alloy stock may be homogenized, preferably at temperatures in the range of 480° C. to 590° C. A range of 510° C. to 565° C. for at least one hour is also suitable. The purpose of the homogenization is to dissolve soluble elements such as lithium, copper, zinc, and magnesium, and to render the internal structure of the metal uniform. Preferably, homogenization is conducted for more than 10 hours, and typically 20 hours or more. Normally, thermal ramping to the homogenizing temperature and the homogenizing treatment itself does not exceed about 40 hours. However, longer homogenization is not generally detrimental. A time of 15 to 40 hours at the homogenization temperature is quite suitable. Homogenization is not always necessary, as further discussed later herein.

Following homogenization, the metal ingot, billet, or other alloy form can be rolled, extruded, or otherwise worked to produce stock such as sheet, plate, extrusions, or other alloy forms. To produce flat sheets, the alloy is preferably hot rolled to a thickness ranging from 0.1 to 0.25 inch for sheet and 0.25 to 6.0 inches for plate. For hot rolling purposes, the temperature should be in the range of about 390° C. to 590° C. A range of 400° C. to 540° C. is also suitable. In a further embodiment, the metal temperature in such hot working operations is in the range of 455° C. to 525° C.

When the product obtained from plate is to have a thick section, further operations following hot rolling are unnecessary except as indicated below. Where the intended use requires a thinner gauge, as may be used in fuel tanks or body panels, further reduction in thickness by cold rolling is useful cold rolling may provide a sheet thickness ranging, in a non-limiting sense, from 0.010 to 0.25 inch and most often from about 0.03 inch to about 0.20 inch.

Following working, whether by hot working alone or a combination of hot working and cold working, the alloy article is subjected to a solution heat treatment to dissolve soluble elements. The solution heat treatment is preferably accomplished at a temperature in the range of 450° C. to 570° C. and may produce an unrecrystallized grain structure for plate and a recrystallized grain structure for sheet.

In the present invention, short transverse properties, e.g. short transverse toughness, can be improved by carefully controlled thermal and mechanical operations in combination with alloying of the lithium-containing aluminum base alloy. Zirconium content of the alloy is suitably in the range of 0.03 to 1.0 weight percent, with a typical amount being in the range of 0.03 to 0.8 weight percent. The amount of zirconium has been found to significantly effect short transverse properties. In a further embodiment, zirconium is used in amounts of from about 0.05 to about 0.08 weight percent. The amount of other grain refiners may be varied along with the amount of zirconium. These amounts may be adjusted to permit recrystallization of an intermediate product, yet of sufficient concentration to retard recrystallization during solution heat treating if a non-recrystallized plate product is desired. If a recrystallized sheet product, is desired, then the total amount of grain refiners should be kept low.

In one embodiment of the invention, more than 0.20 weight percent of scandium is employed. In a further embodiment, from about 0.25 to about 10.0 weight percent scandium is contained in the alloy. While scandium is sometimes mentioned as an auxiliary grain refiner in small amounts (0.01 to about 0.2 weight percent), it has gone unrecognized that higher amounts promote weldability without sacrificing other properties, i.e. without comprising the ability to produce sheet or plate products having substantially isotropic performance, particularly, with respect to short transverse properties, when processed as proposed herein. If processed conventionally, scandium promotes weldability, but physical properties, particularly short transverse properties, are severely deficient.

To illustrate the manner of the subject invention process, a billet or ingot of an inventive alloy is treated at a "partial grain refining temperature" prior to the hot working operation. The temperature of the partial grain refining operation should be controlled so that a substantial amount of grain boundary precipitate, the particles present along the original dendritic boundaries of the alloy, remain undisolved. Thus, high temperatures at which most of the grain boundary precipitate would be dissolved are avoided. Otherwise, later operations may not be effective. If the partial grain refining temperature is too low, then the billet or ingot will not deform without cracking during hot working. The partial grain refining temperature is thus in the range of 315° C. to 510° C. Ranges of 370° C. to 480° C. and 430° C. to 465° C. are also useful. The ingot may be homogenized prior to the partial grain refinement without significantly affecting product properties. However, the partial grain refining step may be used without a prior homogenization step with no sacrifice in properties.

After the billet or ingot has been heated to the partial grain refining temperature, it is warm worked, i.e. forged, rolled, etc., to provide an intermediate product. Once the billet or ingot has reached the partial grain refining temperature, warm working (low temperature hot working) can commence. However, a longer dwell time at the partial grain refining temperature may be tolerated without adverse effects. For example, the billet or ingot may be held at such temperatures for up to 20 or 30 hours. However, such extended heating periods increase product cost without any substantial improvement in properties or processing. For present purposes, a time of less than 1 hour at the partial grain refining temperature is sufficient.

If the ingot is to be rolled into a final plate product, then the initial "low temperature hot working" may be used to reduce the ingot to a thickness 1.5 to 15 times the desired thickness of the finished plate product. A preferred reduction is one and one half to five times the thickness of the finished plate, with the preferred reduction being two to three times the thickness of the final plate thickness. The low temperature hot working should be initiated in the temperature range of the partial grain refining temperature. However, once initiated, the low temperature hot working can be carried out within the temperature range of 200° C. to 550° C. It should be recognized that the same or similar effects may be obtained with a series of one or both of partial grain refining preheating steps and low temperature hot working steps, without departing from the spirit of the invention.

Following the low temperature hot working step or steps, the intermediate product is then heated to a temperature sufficiently high to induce recrystallization of its grain structure. The "recrystallization temperature" may be in the range of 480° C. to 560° C. or 525° C. to 550° C. It is the particular alloy composition, in conjunction with the recrystallization step and previous steps, which generate the improvement in short transverse properties of plate products fabricated in accordance with the present invention. The use of the term "recrystallization" includes partial recrystallization as well as complete recrystallization. Such terms are familiar to one skilled in the art of aluminum alloys, in particular, lithium/aluminum alloys.

Following recrystallization, the recrystallized intermediate product is hot worked to final product shape. As indicated previously, to produce a sheet or plate product, the intermediate product is hot rolled to a thickness ranging from 0.1 to 0.25 inch for sheet and 0.25 to 10.0 inches for plate. For this final hot working operation, the temperature should be in the range of 400° C. to 550° C. The metal alloy's initial temperature should be in the range of 480° C. to 535° C. With respect to the hot working step, it is important that the temperatures be carefully controlled within these ranges.

Improved short transverse properties are achieved by solution heat treating. Solution heat treating must be performed in a well controlled manner to ensure substantially unrecrystallized grain structure for plate, when such grain structure is desired. The alloy must generally contain a minimum level of scandium and/or manganese in such cases, to retard recrystallization of the final product during solution heating treating. Similarly, care must be exercised during final hot working to guard against using a temperature which is too low. Undue amounts of working of the alloy during hot working can encourage recrystallization in the final product during solution heat treating. Adjustment of the hot working temperature and the amount of work input are within the level of skill in the art.

If a sheet product having high resistance to both exfoliation and stress corrosion cracking is desired, the intermediate product may be cold rolled to sheet gauge after the recrystallization step. By "cold rolling" is meant rolling at relatively low temperatures for example from below ambient to about 150° C. Cold rolling has the effect of elongating grains formed during recrystallization. The elongated grains thus produced provide high resistance to both exfoliation corrosion and to stress corrosion cracking. The grains preferably have an aspect ratio of 1.5 to 20, more preferably 2 to 10. In order to form elongated grains of the desired aspect ratio, it may be necessary to provide several cold rolling passes with intermediate anneals. In order to maintain the elongated grains, it is highly important to avoid conditions such that the grains may revert to their original configuration while achieving the solution heat treating temperature. Thus, after cold rolling, the sheet product may be subjected to a stepped anneal by first heating to from 400° C. to 430° C., following which over an extended period, for example 20 minutes to 30 hours, heating at a low rate, i.e. 1° C./hr to 110° C./hr, typically 5° C./hr to 8° C./hr to about 480° C. The product can then be further heated to solution heat treating temperatures.

To alter the directivity of properties, i.e. to produce an end product which is one having properties which are more or less uniform in all directions, the low temperature hot working operation can be further controlled. For example, if the desired end product is substantially free of an intense, worked texture so as to result in improved properties in the 450° direction, a series of stepped low temperature hot working operations, where the working operation and the temperature are separately controlled in each of a series of steps may be used.

Thus, after the partial grain refinement preheat, the billet or ingot may be reduced by about 5% to 35% of the thickness of the original billet or ingot in the first step of the low temperature hot working operation with reductions in the order of 10% to 25% of the billet or ingot thickness being common. The temperature for this first step should be in the range of about 355° C. to 500° C. In a second step, a further reduction of the order of 20 to 50% of the thickness of the material from the first step is produced. This further reduction may advantageously be about 25% to 35%. The temperature in the second step reduction should not be greater than 350° C., and generally is in the range of 260° C. to 340° C. In a third step, a yet further reduction may be 20% to 40% of the thickness of the material from the second reduction, and the temperature should be in the range of 177° C. to 260° C. with a typical temperature being in the range of 200° C. to 250° C. These steps provide an intermediate product which is recrystallized. The partial grain refining temperature preheat, low temperature hot working coupled with temperature control, and recrystallization of the intermediate product are referred to herein as "alloy recrystallization". Alloy crystallization as herein defined allows the relative aniostropy of the mechanical characteristics to be varied. If desired, a final product which is substantially isotropic may be produced.

While the foregoing description has been illustrated by referring to a three-step process, it will be noted that the scope of the invention is not thus limited. A plurality of low temperature hot working operations may be employed to control aniostrophy, depending on the desired final properties. This flexibility is attainable as a result of the use of the particular alloy of the subject invention in conjunction with low temperature hot working operations and recrystallization of the intermediate product.

To further provide for improved strength, fracture toughness, and corrosion resistance, necessary to the final product and to the operations in forming that product, the product should be quenched following solution heat treating to prevent or minimize uncontrolled precipitation of strengthening phases. The quenching rate may be at least 50° C. per second from solution temperature to a temperature of about 95° C. or lower, and may desirably be at least 100° C. per second in the temperature range of 95° C. to 480° C. or higher. After the metal has reached a temperature of about 95° C., it may then be air cooled.

Following quenching of the alloy product, the product may be artificially aged to provide the desired combination of fracture toughness and strength. Aging can be accomplished by exposing the sheet, plate, or other product to a temperature in the range of 65° C. to 200° C. for a sufficient period of time to further increase the yield strength. Strengths in the range of 50 ksi to 85 ksi and higher, together with corresponding fracture toughness for plate products in the range of 15 ksi-in to 75 ksi-in may be achieved. Preferably, artificial aging is induced by treating the alloy product at a temperature in the range of 120° C. to 190° C. for a period of at least 30 minutes. For example, a suitable aging practice comprises a treatment over 8 to 24 hours at a temperature of about 160° C. The alloy product may also be subjected to any typical underaging treatments known in the art, including natural aging and multi-step agings. Multiple aging steps are also contemplated. Stretching or its equivalent working may be used prior to or after one or more of such multiple aging steps.

While one or more embodiments of the invention have been described, it is not intended that such disclosure describes all possible forms of the invention. It is intended that the following claims cover all modifications and alternative designs, and all equivalents, that fall within the spirit and scope of this invention.

What is claimed is:

1. A process for preparing weldable aluminum/lithium high strength alloy of making lithium containing products exhibiting substantially isotropic properties said process comprising:

(a) casting an alloy body from an alloy having the following composition in weight percent:
Li (1.5 to 3.0)
Cu (1.0 to 4.0)
Sc (>0.2 to 10.0)
Si (0.03 to 1.0)
Fe (0.03 to 1.0)
Mn (0.05 to 1.0)
Mg (0.05 to 1.0)
Zn (0.05 to 1.0)
Zr (0.01 to 1.0)
Ti (0.05 to 1.0)
Others, maximum 2.0, balance aluminum;

(b) raising the temperature of said body to a partial grain refining temperature;

(c) subjecting said body to at least one controlled low temperature hot working operation to provide an intermediate product;

(d) recrystallizing said intermediate product to form a recrystallized product;

(e) hot working said recrystallized product; and (f) solution heat treating, quenching and aging said recrystallized and hot worked product.

2. The process of claim 1 wherein said alloy comprises about 1.8% to about 2.3% Li; about 2.5% to about 3.0% Cu, and about 0.23 to about 1.0% Sc.

3. The process of claim 1 wherein said alloy comprises about 2.05% Li; 2.7% Cu; and 0.3% Sc.

4. A process for preparing weldable aluminum/lithium alloy flat rolled products exhibiting substantially isotropic properties, said process comprising:

(a) casting an alloy body from an alloy having the following composition in weight percent:
Li (1.5 to 3.0)
Cu (1.0 to 4.0)
Sc (>0.2 to 10.0)

Si (0.03 to 1.0)
Fe (0.03 to 1.0)
Mn (0.05 to 1.0)
Mg (0.05 to 1.0)
Zn (0.05 to 1.0)
Zr (0.01 to 1.0)
Ti (0.05 to 1.0)
Others, maximum 2.0, balance aluminum;

(b) heating the body to a temperature in the range of 370° C. to 480° C.;

(c) subjecting said heated body to at least two low temperature hot rolling operations wherein a first low temperature hot rolling operation takes place at a temperature higher than the temperature of the second low temperature operations, said at least two low temperature rolling operations providing an intermediate flat rolled product having a thickness 1.5 to 15 times that of a final product;

(d) recrystallizing said intermediate flat rolled product at a temperature in the range of 480° C. to 560° C. to form a recrystallized product;

(e) hot rolling said recrystallized product to a final thickness product, said hot rolling of said recrystallized product conducted at a temperature of between 480° C. and 560° C.;

(f) solution heat treating and quenching said final thickness product; and (g) aging said final thickness product.

5. The process of claim 4 wherein said alloy comprises about 1.8% to about 2.3% Li; about 2.5% to about 3.0% Cu, and about 0.23% to about 1.0% Sc.

6. The process of claim 4 wherein said alloy comprises about 2.05% Li; 2.7% Cu; and 0.3% Sc.

7. A process for preparing weldable aluminum/lithium alloy flat rolled products exhibiting substantially isotropic properties, said process comprising:

(a) casting an alloy body from an alloy having the following composition in weight percent:

Li (1.5 to 3.0)
Cu (1.0 to 4.0)
Sc (>0.2 to 10.0)
Si (0.03 to 1.0)
Fe (0.03 to 1.0)
Mn (0.05 to 1.0)
Mg (0.05 to 1.0)
Zn (0.05 to 1.0)
Zr (0.01 to 1.0)
Ti (0.05 to 1.0)
Others, maximum 2.0, balance aluminum;

(b) heating the body to a temperature in the range of 370° C. to 480° C.;

(c) subjecting said heated body to at least two low temperature hot rolling operations wherein a first low temperature hot rolling operation takes place at a temperature higher than the temperature of the second low temperature operations, said at least two low temperature rolling operations providing an intermediate flat rolled product having a thickness 1.5 to 15 times that of a final product;

(d) recrystallizing said intermediate flat rolled product at a temperature in the range of 480° C. to 560° C. to form a recrystallized product;

(e) cold rolling said recrystallized product to produce a final thickness product;

(f) solution heat treating and quenching said final thickness product; and (g) aging said final thickness product.

8. The process of claim 7 wherein said alloy comprises about 1.8% to about 2.3% Li; about 2.5% to about 3.0% Cu, and about 0.23% to about 1.0% Sc.

9. The process of claim 7 wherein said alloy comprises about 2.05% Li; 2.7% Cu; and 0.3% Sc.

* * * * *